US005878885A

United States Patent [19]

Wangu et al.

[11] Patent Number: 5,878,885

[45] Date of Patent: Mar. 9, 1999

[54] BLISTER PACKAGE WITH SLOPED RAISED FORMATIONS

[75] Inventors: Manoj K. Wangu, Wexford; Allen D. Bowers, Pittsburgh, both of Pa.

[73] Assignee: Automated Healthcare, Inc., Pittsburgh, Pa.

[21] Appl. No.: 949,347

[22] Filed: Oct. 14, 1997

[51] Int. Cl.[6] ..... B65D 73/00

[52] U.S. Cl. ..... 206/461; 206/462; 206/526

[58] Field of Search ..... 206/461, 462, 206/463, 471, 526, 806, 464, 465, 470; D9/415

[56] References Cited

U.S. PATENT DOCUMENTS

| | | | |
|---|---|---|---|
| Re. 26,493 | 12/1968 | Stoker, Jr. | 206/461 X |
| D. 218,403 | 8/1970 | Ericdeberg | D9/415 |
| D. 262,190 | 12/1981 | Stanton . | |
| D. 307,554 | 5/1990 | McAlister, Sr. | D9/415 |
| D. 313,554 | 1/1991 | Clark . | |
| D. 315,871 | 4/1991 | Whitebread | D9/415 |
| D. 329,017 | 9/1992 | Goodale . | |
| D. 342,025 | 12/1993 | Abraben et al. . | |
| D. 363,021 | 10/1995 | Lombard . | |
| D. 364,739 | 12/1995 | Okamoto et al. . | |
| D. 384,578 | 10/1997 | Wangu et al. | D9/415 |
| 3,165,234 | 1/1965 | Conklin et al. | 206/806 X |
| 3,931,885 | 1/1976 | Nahill et al. . | |
| 3,933,245 | 1/1976 | Mullen . | |
| 4,211,329 | 7/1980 | Braverman . | |
| 4,371,080 | 2/1983 | Haines . | |
| 4,429,792 | 2/1984 | Machbitz . | |
| 4,574,954 | 3/1986 | Reid . | |
| 4,739,883 | 4/1988 | Mohs et al. . | |
| 4,838,425 | 6/1989 | O'Brien et al. . | |
| 4,850,488 | 7/1989 | Humbert . | |
| 4,854,450 | 8/1989 | Fisher | 206/469 |
| 5,020,669 | 6/1991 | Nakagoshi | 706/461 X |
| 5,029,705 | 7/1991 | Schmidt et al. | 206/471 X |
| 5,033,616 | 7/1991 | Wyser . | |
| 5,150,793 | 9/1992 | Tannenbaum . | |
| 5,169,001 | 12/1992 | Scheibel . | |
| 5,224,091 | 6/1993 | Tannenbaum . | |
| 5,390,794 | 2/1995 | Vulpitta | 206/806 X |
| 5,573,117 | 11/1996 | Adams . | |
| 5,649,624 | 7/1997 | Seaton | 206/461 |

FOREIGN PATENT DOCUMENTS

| | | | |
|---|---|---|---|
| 3008466 | 9/1981 | Germany | 206/806 |

*Primary Examiner*—Bryon P. Gehman
*Attorney, Agent, or Firm*—Buchanan Ingersoll, P.C.

[57] ABSTRACT

A blister package with a hole in it for hanging the package on a rod has a thin plastic front sheet attached to back and a raised receptacle or blister is formed in the plastic sheet sized to enclose an article. The plastic sheet further has a raised formation near each top corner on the front of the blister package. The raised formation is shaped to space the package from an adjacent package when hung on a rod and to resist getting caught on the top edge of an adjacent blister package if the package is rotated about the rod. The raised formation has a peak and sloping sides extending from the peak toward the edges of the package. The profile is generally smooth such that there are no ledges to catch on the top edge of an adjacent blister pack. The hole is located a first distance from the top edge of the blister package and each projection is spaced a second distance from the hole. The second distance is made less than the first distance such that if the blister package were rotated 90 degrees a raised formation could not get caught on the top edge of an adjacent blister package. Preferably a bar code is provided on the outside of the back where it can be read by a bar code reader.

10 Claims, 4 Drawing Sheets

Fig.3.
Prior Art
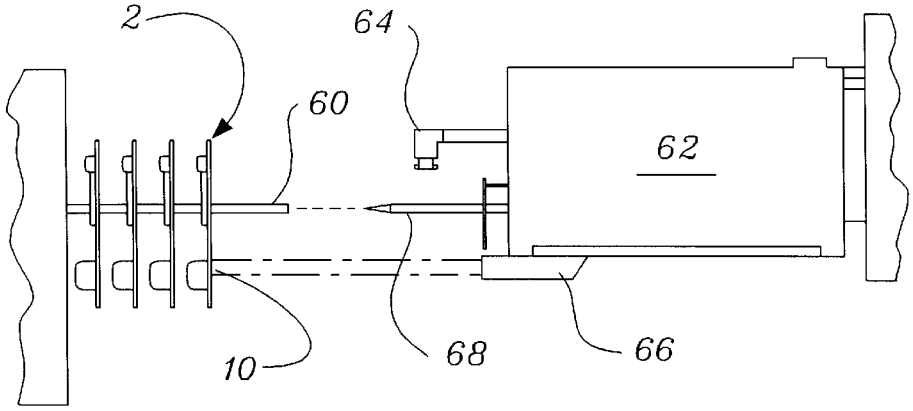
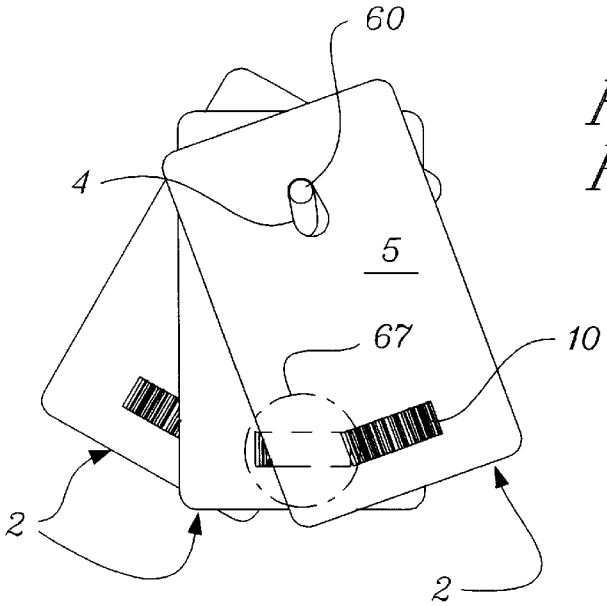
Fig.4.
Prior Art
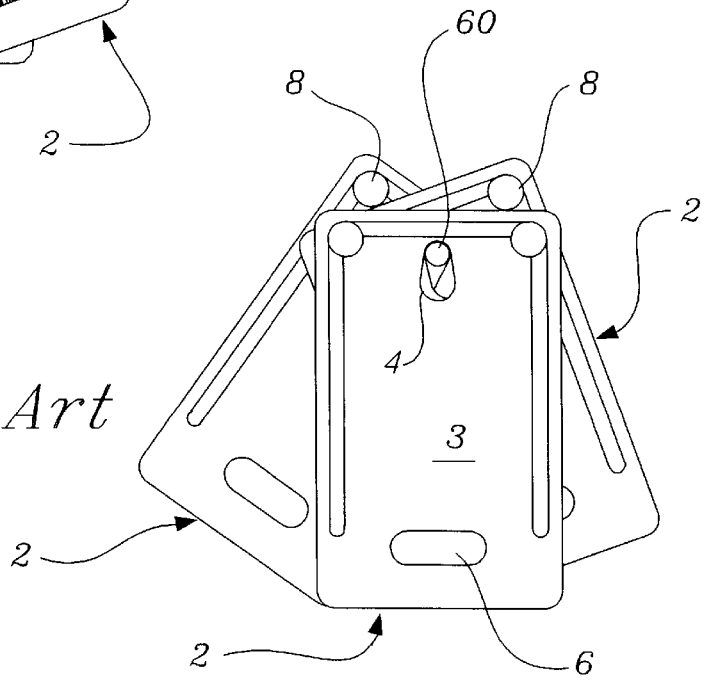
Fig.5.
Prior Art 20
25
24
23
34
B 20
25
28
29
32
37
26
21
23

20
25
36
A
31
28
29
28
30
30
24
21
33
32
35
37
26

BLISTER PACKAGE WITH SLOPED RAISED FORMATIONS

FIELD OF THE INVENTION

The invention generally relates to a blister package and more particularly to a blister package for a unit dosage of medication which is held on a storage rod in an automated storage and retrieval system.

BACKGROUND OF THE INVENTION

Blister packages are well-known for storing and displaying articles. Blister packages are commonly comprised of a thin front sheet of plastic joined to a back sheet, such as foil, paper, plastic or cardboard. At least one raised receptacle or blister is formed in the thin plastic sheet which is sized and configured to hold on article. A portion of the back over the blister may be perforated to enable the article to be removed by opening that portion at the back. Other blister packages are opened by peeling the blister from the back. The blister package commonly has a hole through it to allow it to be hung on a rod. Typically, a number of such packages are held on a single rod.

Another type of blister package, called a clam shell pack, has a plastic front and back that are hinged together along one edge, typically the bottom edge. The front usually has one blister for holding the product. The unattached edges of the front and back are configured to lock together. An example of this type of blister package is disclosed in U.S. Pat. Nos. 4,739,883 and 5,573,117.

Blister packages are commonly used to package medicine. Typically, the front has multiple blisters each holding a single pill or lozenge. Examples of blister packages for dispensing medication can be found in U.S. Pat. Nos. 4,574,954; 4,492,792; 3,211,503 and 3,283,885. In recent years medicine has been packaged in blister packages sized to hold a single dose of medicine. These unit dose packages are popular in hospitals and nursing homes.

Most consumer packages today carry bar codes that can be automatically scanned to identify the item being purchased or used. The bar code of a unit dose medicine package may contain not only the product identification, but also the expiration date. Hospitals are increasingly using bar codes on unit dose packages to identify and record medicine given to each patient. U.S. Pat. No. 5,593,267 discloses an automated pharmacy in which unit dose medicine packages are stored on racks and retrieved by a robot. An automated picker locates and selects the packages containing prescribed medicine from storage rods at discreet locations in the storage area of the automated pharmacy. Most unit dose medicine packages are blister packages that have a bar code on the back which faces forward when the package is held on the storage rod. The robot has a bar code reader to identify each blister package as it is removed from a rod. To keep the blister packages spaced apart on the rod, blister packages used in the automated pharmacy have raised formations on the thin plastic sheet. One such package disclosed in our U.S. Pat. No. Des. 384,578 has such a projection on each upper corner with the medicine containing a blister centered in the bottom half of the package. This configuration equally spaces the blister packages on a storage rod. However, this raised formation also can cause certain problems when a number of such blister packages are loaded and held on such a storage rod. If the package is turned a sufficient amount to either side while hanging on the rod, the raised formation has a tendency to get caught on the top edge of an adjacent package. Then, the blister package hangs from the storage rod at an angle. When the robot attempts to retrieve the package the bar code on the blister package is not in the expected, relatively level position for it to be easily read by the bar code reader on the automated picker. The bar code reader may then read the bar code on the package behind the front package, conclude that no package is on the rod, or report that it is unable to find a package on the storage rod. Then, the operator may be required to stop the robot, enter the storage area and straighten the blister packages.

Thus, there is a need for a blister package which will not get caught on the top edge of an adjacent blister package and will hang vertically when stored on a rod.

SUMMARY OF THE INVENTION

In accordance with the present invention, we provide an improved blister package having a hole therethrough to hang the package are on a rod. The preferred blister package is formed in a conventional manner by attaching a foil covered paper back to a thin plastic front sheet which has a raised receptacle formed therein that is sized to enclose an article. The article is preferably a unit dose of medication.

The thin plastic sheet has a raised formation along the upper sides of the front to maintain spacing from an adjacent package. Each raised formation is curved or tapered so as to resist getting caught on the top edge of an adjacent blister package when a number of such packages are hung on a rod. Thus, each blister package will hang vertically from the rod in alignment with the other packages on the rod. Preferably, the raised formation has a pair of sloping opposite sides, and one raised formation is located in each upper corner on the front of the package. In a preferred embodiment the slope is steeper on the surface that extends toward the top of the package than the surface that extends toward the bottom. The profile is generally smooth so that there are no ledges or comers which could get caught on the top edge of an adjacent blister pack. The sides preferably are flat, but the sides could be arcuate shaped.

Each raised formation is preferably spaced a first distance from the hole which is located a second distance from the top edge of the blister package. Making the first distance less than the second distance assures that there is not enough space between the storage rod and raised formation to enable the package to get caught on the top edge of an adjacent blister pack, even if the blister package were rotated 90 degrees with respect to an adjacent blister pack.

The bar code is preferably provided on the outside of the back of the package below the hole where it can be read by a bar code reader to identify the package and its contents.

Other details, objects, and advantages of the invention will become apparent from the following description and the accompanying drawings of certain presently preferred embodiments thereof.

BRIEF DESCRIPTION OF THE DRAWING FIGURES

In the accompanying figures certain preferred embodiments of the invention are illustrated in which:

FIG. 3 is a side view of a prior art type automated picker positioned to select blister packages from a storage rod on which a number of packages are held;

FIG. 4 is a front view of a storage rod showing multiple blister packages of the type shown in FIG. 1 hanging on the storage rod in a non-uniform manner;

FIG. 5 is a rear view of the storage rod and packages shown in FIG. 4;

DETAILED DESCRIPTION OF THE PREFERRED EMBODIMENTS

Figure 1:
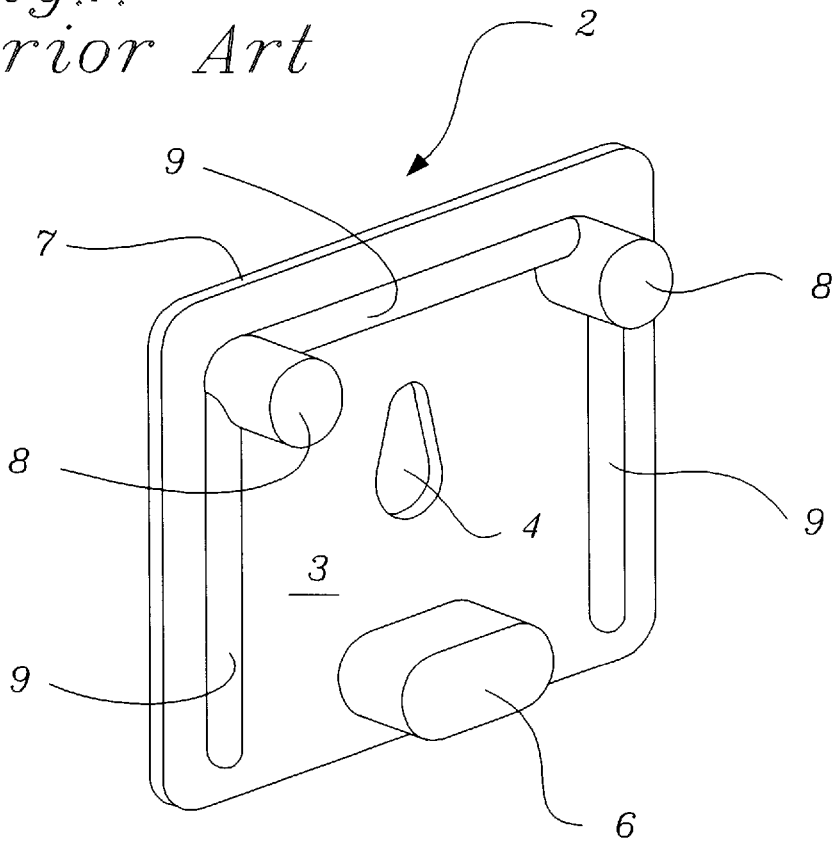
Fig.1. Prior Art
FIG. 1 is a perspective view of a prior art type blister package.
Figure 2:
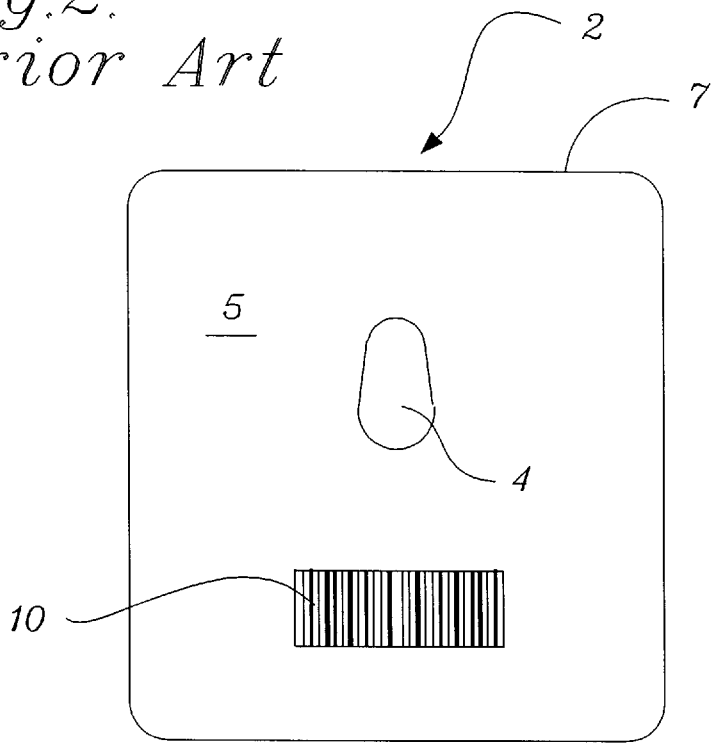
Fig.2. Prior Art
FIG. 2 is a rear elevational view of the blister package of FIG. 1.
Figure 6:
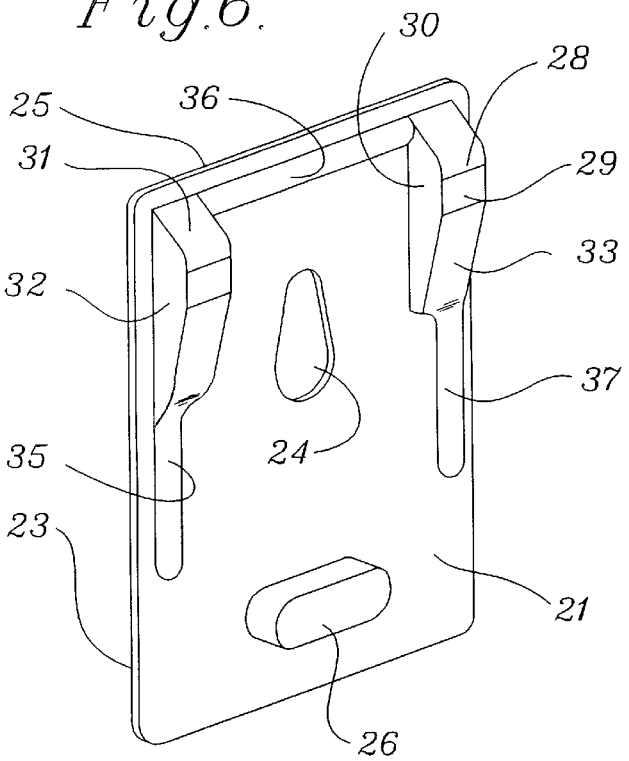
FIG. 6 is a perspective of a present preferred embodiment of a blister package of the present invention.

To aid in understanding the present preferred embodiments it will be helpful to first describe a typical blister package as shown in FIGS. 1 through 5. The blister package 2 has a hole 4 in it for hanging the package on a rod. The package 2 is formed from a thin plastic front sheet 3 attached to a foil coated paper or cardboard back 5. A receptacle or blister 6 is formed in the plastic front sheet 3 which is sized to enclose a unit dosage of medication. A raised cylindrical protrusion is provided in each upper corner and reinforcing ribs 9 extend from each projection along three sides of the package. A bar code 10 is preferably provided on the outside of the back 5 of the blister package 2 which is encoded with information such as the type of medication, expiration date, lot number, dosage, and the patient identification. If desired the bar code could be on the front of the package. When these packages are hung on a storage rod in an automated storage and retrieval system the surface of the package bearing the bar code faces outward.

The protrusions 8 near the corners of the package 2 typically extend outwards a distance equal to or farther than the receptacle 6 for the medication. These protrusions space the package 2 from an adjacent package when multiple packages are hung on a storage rod 60, as shown in FIG. 3. These protrusions 8 also enable the packages to lie flat when stacked in boxes and serve to protect the medication contained in the receptacle 6 from being crushed during packing and shipping. A number of such packages 2 can be hung on a storage rod 60. In an automated pharmacy of the type described in U.S. Pat. No. 5,593,267 an automated picker 62, shown in FIG. 3, can retrieve the blister packages 2 as needed to fill a prescription order. The automated picker 62 has a bar code reader 66 which identifies the desired blister package 2 by reading the bar code 10 provided thereon. A suction arm 64 is then moved into position and grasps the identified blister package 2 and loads it onto a temporary storage rod 68. Selected packages are then taken to a filling station where they are removed from rod 68 into a patient drawer. However, a problem can arise if a blister package 2 does not hang vertically from the storage rod 6. As illustrated in FIGS. 4 and 5, when a number of such blister packages 2 are loaded onto the storage rod a package may rotate so that a protrusion 8 gets caught on the top edge 7 of an adjacent blister package 2. In FIGS. 4 and 5 two packages are shown in skewed positions. Consequently, the skewed packages 2 do not hang vertically from the storage rod and the bar code 10 on the packages 2 that are skewed are not where they should be. The bar code reader 66 on the automatic picker is designed to scan a certain location 67, shown in chain line in FIGS. 3 and 10, where the bar code 10 is expected to be. If the package 2 is skewed to one side it may be impossible for the bar code reader 66 to identify the particular package 2. The reader may read the bar code on a properly hung package behind the first package, report that the rod is empty or signal an error.

Referring now to FIGS. 6 through 10, we provide a blister package 20 having a hole 24 therethrough for hanging the blister package 20 on a rod. The blister package 24 can be manufactured in a conventional manner from a thin plastic front sheet 21 attached to a foil, paper, cardboard or plastic back 23. The plastic front sheet 21 has a receptacle 26 formed therein which is sized to enclose an article, preferably a unit dose of medicine. The plastic front sheet 21 further has a raised formation 28 near each upper corner. Those formations space the package from an adjacent blister package but will not get caught on the top edge 25 of an adjacent package. Reinforcement ribs 35, 36 and 37 extend from the raised formations parallel to the edges of the package. The ribs are only about 0.2 cm high and 0.4 cm wide and have a hemispherical cross section. Preferably a bar code 34 is provided on the outside of the back 23 so that an automated picker 62, as shown in FIG. 3, can identify the blister package and the medication it contains in the manner previously described.

Figure 11:
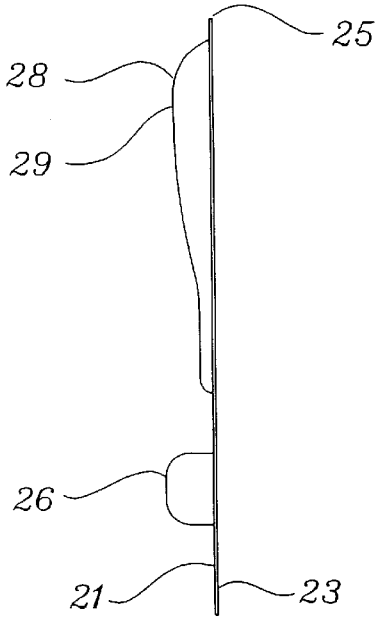
FIG. 11 is a side view of a second preferred alternative embodiment of our blister package.

Each raised formation 28 has a peak 29 which extends farthest from the back 23. Sides 30, 31, 32 and 33 extend downwards from the peak 29 toward the back 23. The sides 31 and 33 which extend toward the top and bottom edges are flat and have a gradual slope of from 10° to 45°. We prefer to provide a slope of 15° on side 33 and 45° on side 31. The projection 29 preferably is 2.5 cm long, 0.5 cm wide and 0.5 cm high. We further prefer that the peak 29 be a flat landing of at least 0.5 cm square. The other two sides 30 and 32 opposite the sides of the package are perpendicular to the back, but could also be sloped. Alternatively, each side could have the arcuate shaped profile as in the embodiment which is shown in FIG. 11. In either case, it is preferable that the profile be generally smooth such that there are no ledges or comers which could get caught on the top edge 25 of an adjacent blister package 20. Consequently, unlike the side walls of the protrusion 8 of the prior art, the sloping sides 31 and 33 resist getting caught on the top edge 25 of an adjacent blister package 20. Thus, the blister packages will hang uniformly from the rod 60. This ensures that the bar code 34 will be in the position corresponding to the location 67 which is scanned by the automated picker 66.

Figure 10:
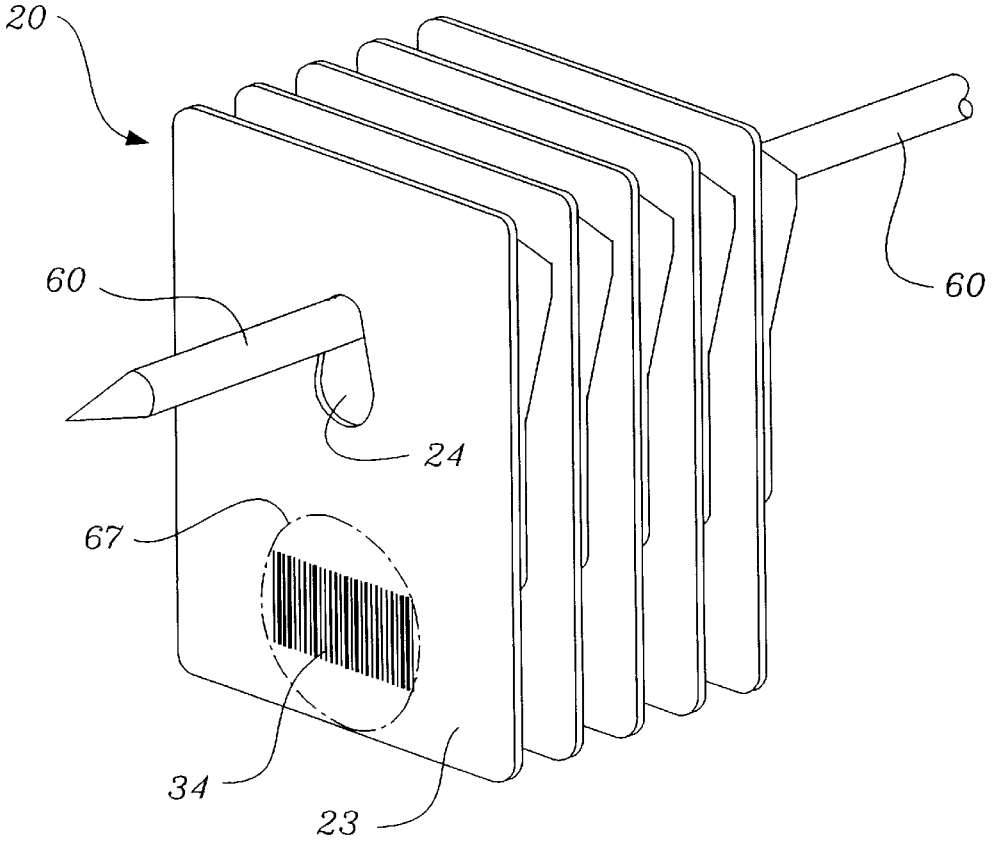
FIG. 10 is a perspective view of a number of the blister packages shown in FIG. 6 held on a storage rod.
Figure 9:
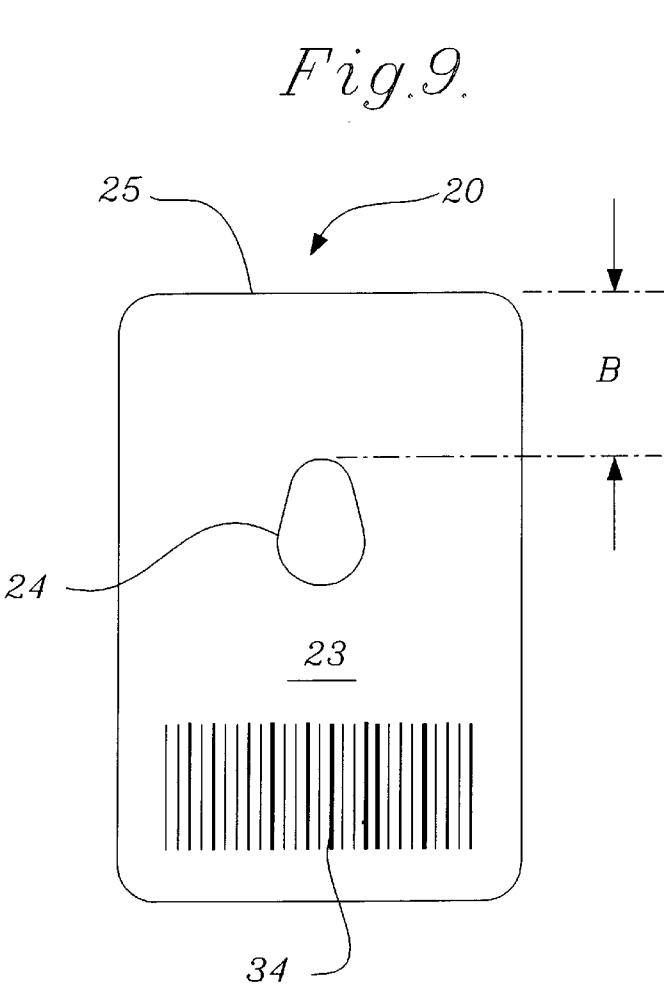
FIG. 9 is a rear elevational view of the blister package shown in FIG. 8.
Figure 8:
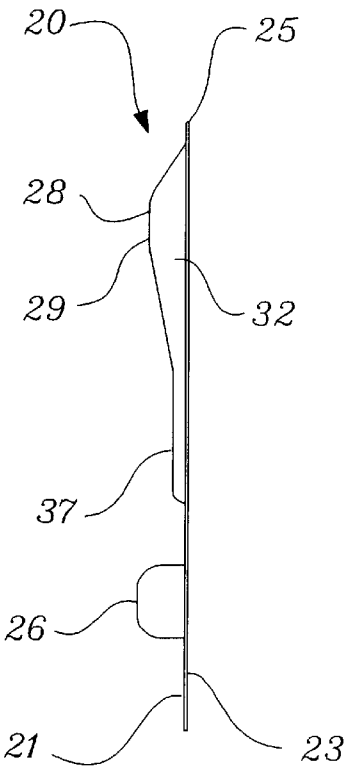
FIG. 8 is a side elevational view of the blister package shown in FIG. 7.
Figure 7:
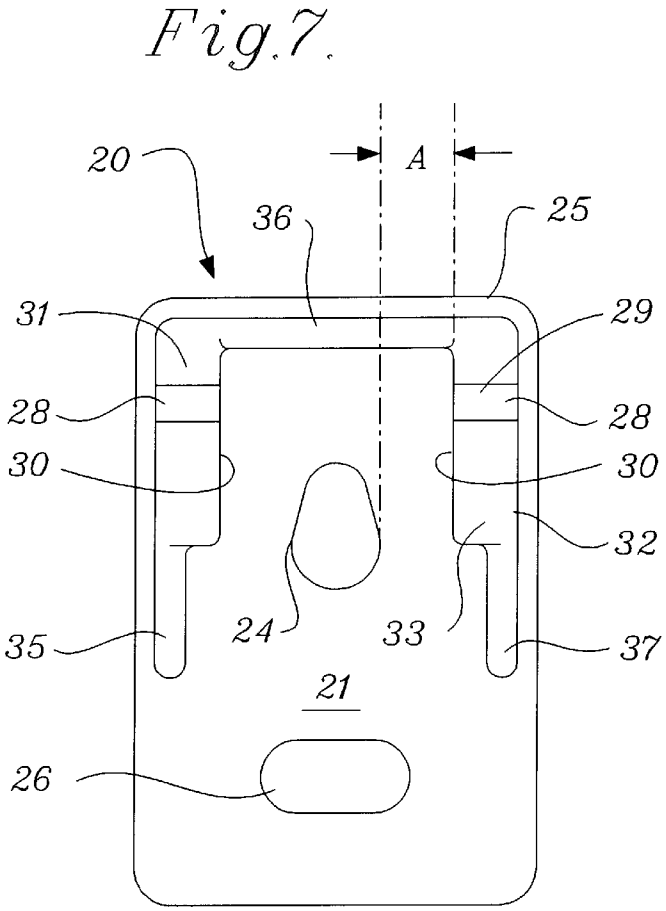
FIG. 7 is a front elevational view of the blister package shown in FIG. 6.

If our blister package were to be rotated 90 degrees with respect to an adjacent blister package it might be possible for the perpendicular sides 30 and 32 of the protrusion 28 to get caught on the top edge 25 of an adjacent blister package should that side contact the top of an adjacent package. To avoid this potential problem the projections 28 are spaced a certain distance from the hole 24, labeled "A" in FIG. 7. That hole 24 is spaced a second distance from the top edge 25 of the blister package 20, labeled "B" in FIG. 9. The distances are chosen so that distance "A" is less than distance "B." Consequently, when multiple blister packages 20 are held on a storage rod 60 blister packages cannot be rotated on the rod to a position where the inner side of a projection is above the top of an adjacent package. Therefore, the inner side cannot get caught on the top edge 25 of an adjacent blister package, even if the blister package were rotated 90 degrees with respect to an adjacent blister package. As a result, when a number of blister packages 20 are hung on a rod 60 the formations 28 resist getting caught on the top edge 25 of an adjacent blister package 20. Thus, the blister packages 20 will hang from the rod 60 in a generally aligned manner, as shown in FIG. 10. The bar code 34 on the blister package 20 will be in the preferred, relatively level position for it to be easily and accurately read by a bar code reader 66 on the automated picker 62.

Although the improved blister package has been described primarily in connection with blister packages containing a unit dose of medication, and particularly for blister packages for use in an automated pharmacy, it should be recognized that such an improved blister package could also be employed hold other types of articles. Our blister package is not limited for use in an automated storage and retrieval system. Some may choose this package for purely aesthetic reasons because they want the blister package in their store or other location to hang vertically from the rod in a uniform manner.

For ease of description the portion of the packages shown in the drawings that contain the blister is called the front and the paper, plastic, cardboard or foil attached to that portion is called the back. These terms should not be viewed as limiting the invention as one could easily have called the blister containing portion the back and the other portion the front.

In the embodiments shown in the figures the front and back are shown to have the same length and width. It should be understood that this is not required as the blister portion, or front, could be smaller than the back such as commonly occurs is blister packages containing consumer products. Furthermore, the term blister packages should be understood to include clam shell packages such as those described in U.S. Pat. Nos. 4,739,883 and 5,573,117.

Accordingly, while certain embodiments of the invention have been described in detail, it will be appreciated by those skilled in the art that various modification to those details could be developed in light of the overall teaching of the disclosure. Thus, the particular embodiments disclosed herein are intended to be illustrative only and not limiting to the scope of the invention which may be variously embodied within the scope of the following claims.

We claim:

1. A blister package comprised of:

a back having two upper comers, a top edge extending between the upper corners, a front surface and a hole passing through the back for hanging the package on a rod;

a product containing blister attached to the front surface below the hole and having height from the front surface; and a raised formation on the front surface near each upper corner, each raised formation spaced apart from the other raised formation and from the product containing blister and having a peak which has a height from the front surface that is not less than the height of the blister and sides extending from the peak, at least one said side having a slope relative to the front surface of less than 90° and facing away from the top edge so that the at least one said side will not catch on a top edge of an adjacent blister package when both packages are hung on a rod.

2. The blister package of claim 1 wherein the back also has a bottom edge and two opposite side edges and each raised formation has four sides each of which is facing a different edge of the back.

3. The blister package of claim 2 wherein the sides of the formation facing the side edges of the back are perpendicular to the back and the side facing the top edge and the side facing the bottom edge both have slopes relative to the front surface of less than 90°.

4. The blister package of claim 1 wherein at least one of the sides of each formation is arcuate shaped.

5. The blister package of claim 1 wherein the hole is spaced a first distance from a top edge of the package and each raised formation is spaced a second distance from the hole, the second distance being less than the first distance.

6. The blister package of claim 1 further comprising a bar code provided on an outside surface of the package.

7. The blister package of claim 1 wherein the product containing blister is sized and configured to hold a unit dose of medicine.

8. The blister package of claim 1 further comprising a landing on the peak.

9. A blister package comprised of:

a back having two upper corners, a top edge extending between the upper corners, a front surface and a hole passing through the back for hanging the package on a rod;

a product containing blister attached to the front surface below the hole; and a raised formation on the front surface near each upper corner, each raised formation spaced apart from the other raised formation and from the product containing blister and having a peak and sides extending from the peak, at least one said side having a slope relative to the front surface of between 10° and 45° and facing away from the top edge.

10. The blister package of claim 9 wherein one side of each formation slopes toward a bottom edge of the package at 15° and an opposite side slopes toward a top edge of the package at 45°.

* * * * *